US008459812B2

(12) United States Patent
Wu et al.

(10) Patent No.: US 8,459,812 B2
(45) Date of Patent: Jun. 11, 2013

(54) ELECTRICAL DEVICE WITH ACTUATOR SUPPORT AND VIEWING WINDOW

(75) Inventors: Yun Wu, Queens, NY (US); Alfred J. Lombardi, Syosset, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 296 days.

(21) Appl. No.: 12/768,603

(22) Filed: Apr. 27, 2010

(65) Prior Publication Data

US 2011/0259720 A1 Oct. 27, 2011

(51) Int. Cl.

| | |
|---|---|
| ***F21V 25/00*** | (2006.01) |
| ***H01H 3/04*** | (2006.01) |
| ***H05B 41/16*** | (2006.01) |

(52) U.S. Cl.

USPC ..... 362/23.01; 362/800; 362/583; 362/235; 362/85; 200/335; 200/339; 200/452; 200/454; 315/246

(58) Field of Classification Search

USPC ..... 362/26, 555, 800, 616, 612, 606, 362/583, 554, 556, 64, 235, 551, 27, 85, 362/23; 200/335, 339, 452, 454, 457, 458, 200/329, 314; 315/246

See application file for complete search history.

(56) References Cited

U.S. PATENT DOCUMENTS

| | | | |
|---|---|---|---|
| 4,218,602 | A | 8/1980 | Creech |
| 4,242,552 | A | 12/1980 | Tibolla |
| 4,710,602 | A | 12/1987 | Baity et al. |
| 4,808,778 | A | 2/1989 | Fujiyoshi |
| 4,943,694 | A | 7/1990 | Kroth |
| 4,947,008 | A | 8/1990 | Sato et al. |
| 5,336,861 | A | 8/1994 | Cummins et al. |
| D360,876 | S | 8/1995 | Hughes |
| 5,895,888 | A | 4/1999 | Arenas et al. |
| 5,934,451 | A | 8/1999 | Yu et al. |
| D416,871 | S | 11/1999 | Todd |

(Continued)

FOREIGN PATENT DOCUMENTS

| | | | |
|---|---|---|---|
| JP | 2000-106049 | A | 4/2000 |
| KR | 20-1992-0003364 | A | 5/1992 |
| KR | 10-2010-0042131 | A | 4/2012 |
| KR | 20-0364974 | A | 4/2012 |

OTHER PUBLICATIONS

International Search Report for PCT/US2011/033664, dated Feb. 8, 2012, 12 pages.

*Primary Examiner* — Evan Dzierzynski
*Assistant Examiner* — Danielle Allen
(74) *Attorney, Agent, or Firm* — Marger Johnson & McCollom PC

(57) ABSTRACT

In one embodiment, a system may include an electrical device having an indicator light source, an actuator having a window, a viewing piece arranged to be visible through the window, and a light guide arranged to guide light from the light source to the viewing piece. The viewing piece may have a receiving portion arranged to receive light from the light guide, and the width of the receiving portion may be substantially larger than the width of the light guide. In another embodiment, a system may include an electrical device having a first support member, and an actuator having a second support member. The actuator may be adapted to move along a path of motion from a retracted position to an extended position, and the first and second support members may be adapted to support the actuator in the extended position with forces that are substantially balanced along the path of motion.

28 Claims, 14 Drawing Sheets

U.S. PATENT DOCUMENTS 6,005,308 A * 12/1999 Bryde et al. ..... 307/157
D440,946 S 4/2001 Yu
D473,528 S 4/2003 Wengrower
6,794,592 B1 9/2004 Lin et al.
6,891,117 B1 5/2005 Gouhl et al.
7,029,919 B2 4/2006 Yang
D523,824 S 6/2006 Lombardi et al.
D534,875 S 1/2007 Wu
7,365,282 B2 * 4/2008 Altonen et al. ..... 200/331
7,415,310 B2 8/2008 Bovee et al.
D576,565 S 9/2008 Chou et al.
D576,566 S 9/2008 Wu et al.
D576,961 S 9/2008 Kidman
D583,335 S 12/2008 Ni
D595,664 S 7/2009 Simard et al.
D606,028 S 12/2009 Chou
D606,029 S 12/2009 Chou
D609,650 S 2/2010 Chou et al.
D651,182 S 12/2011 Alderson et al.
2003/0226682 A1 12/2003 Tufano et al.
2007/0193863 A1 8/2007 Wu
2008/0001549 A1 * 1/2008 Altonen et al. ..... 315/250
2009/0189542 A1 7/2009 Wu et al.
2010/0101924 A1 4/2010 Wu et al.

* cited by examiner

ELECTRICAL DEVICE WITH ACTUATOR SUPPORT AND VIEWING WINDOW

BACKGROUND

FIG. 1 illustrates a prior art dimmer switch that may be installed in a wall-mount electrical box and wired to control the flow of electricity to a lighting load. The dimmer switch includes a housing 10 that encloses a power switch and electronic circuitry to control the amount of power applied to the lighting load. A mounting plate 12 forms a front cover for the housing and positions the dimmer switch against a wall surface when it is mounted to an electrical box with mounting screws 14. A rocker switch actuator enables a user to set the dimming level of the lighting load. Pressing the right side 16 of the actuator increases the dimming level, while pressing the left side 18 decreases the dimming level. A viewing lens 20 channels light from a row of indicator lights inside the dimmer switch that indicate the dimming level. A paddle switch actuator 22 turns the load completely off with one push, and turns the load back on to the previous dimming level with a second push. A locator light feature 24 illuminates when the load is off to enable a user to locate the dimmer switch in a darkened room.

Referring to FIG. 2, the visible components of the dimmer switch of FIG. 1 may be implemented as a color change kit 26 to enable the color of the dimmer switch to be changed in response to changes in decorating, or to replace damaged or worn-out components. The color change kit 26 includes a frame 28 in which the paddle 22 is pivotally mounted. The frame 28 includes compressible snaps 30 that engage with openings 32 on the mounting plate 12 to enable the color change kit to be removed and installed without tools.

FIG. 3 is a cross-sectional view of the viewing lens 20, along with a light pipe system that enables light from indicator lights deep inside the dimming switch to be channeled to a user. Each of seven indicator lights 34 is implemented as a light emitting diode (LED) mounted on a circuit board 36. Light from each LED is channeled through one of seven light pipes 38. Light from an LED travels the length of a light pipe and emerges at the other end. The emerging light 40 travels across a short gap 42 between the light pipe and viewing lens 22, where it enters a corresponding tooth 44 that admits the light into the viewing lens. The geometry and configuration of the components guides the light through the viewing lens in a manner that produces a light pattern 46, and corresponding viewing angle, that is typically less than about 35 degrees.

The viewing lens is made separate from the light pipes to accommodate changes in the length of the gap 42 as the paddle switch is depressed as shown by arrow 43, and to accommodate removing the color change kit, which includes the viewing lens. Though not shown in FIG. 3, light separators are typically included between the individual light pipes 38.

Referring to FIG. 4, the dimmer switch may be implemented with a flip-up paddle design that enables the paddle to pivot to an extended position as shown by arrow 48. Placing the paddle in the extended position may be useful to actuate an air gap switch or to allow access to additional controls that may be located under the paddle. For example, an electronic dimmer switch typically uses a solid state switch to turn the load on and off, and to control the dimming level of the load. There are situations, however, when a solid state switch allows unacceptable leakage current to flow, e.g., when replacing a burned out lamp. Therefore, the paddle may be configured to actuate a microswitch when placed in the extended position. The microswitch provides an air gap opening in the circuit, thereby eliminating leakage current.

To support the paddle in the extended position, the dimming switch includes two support mechanisms 50. FIG. 5 is a cross-sectional view of the support mechanisms 50 shown looking in the direction of arrows A-A in FIG. 4. Each mechanism 50 includes a resilient latch 52 attached to the paddle 22. When the paddle is in the retracted position, i.e., close to the mounting plate of the dimming switch, as shown in FIG. 5, each of the latches is engaged with a projection 54 on a corresponding rigid support member 56. This holds the paddle in the retracted position.

If a user attempts to move the paddle to the extended position, there is initial resistance cause by the enlarged portions of the latches 52 engaging against the projections 54. However, as the amount of force applied to the paddle increases, the resilient latches 52 begin to deflect as shown in FIG. 6. This enables the paddle to move upward as the latches move past the projections 54. When the paddle reaches the fully extended position, as shown in FIG. 7, the resilient latches spring back to their normal position and engage the top of the projections 54. The paddle is thus supported in the extended position until the user pushes down on the paddle with enough force to flex the resilient latches and return them to the latched position as shown in FIG. 5.

DETAILED DESCRIPTION

Some of the inventive principles of this patent disclosure relate to guiding light from an indicator light source on an electrical device to a viewer. Referring to prior art device of FIG. 3, the light 40 shown traveling across the gap between the light pipe and viewing lens may be only a small portion of a wider cone-shaped pattern of light 41 emitted from the light pipe. The width $W_E$ of the light pipe corresponds to a light emitting area at the end of the light pipe. The width $W_R$ of each tooth 44 corresponds to an area of a receiving portion at the end of the tooth. The area of the receiving portion is about the same as the area of the emitting area. However; since the light pattern 41 becomes wider as the emitted light crosses the gap, the receiving area only utilizes a small portion of the emitted light pattern. Thus, some of the inventive principles relate to methods and apparatus for better utilizing the emitted light pattern.

Figure 8:
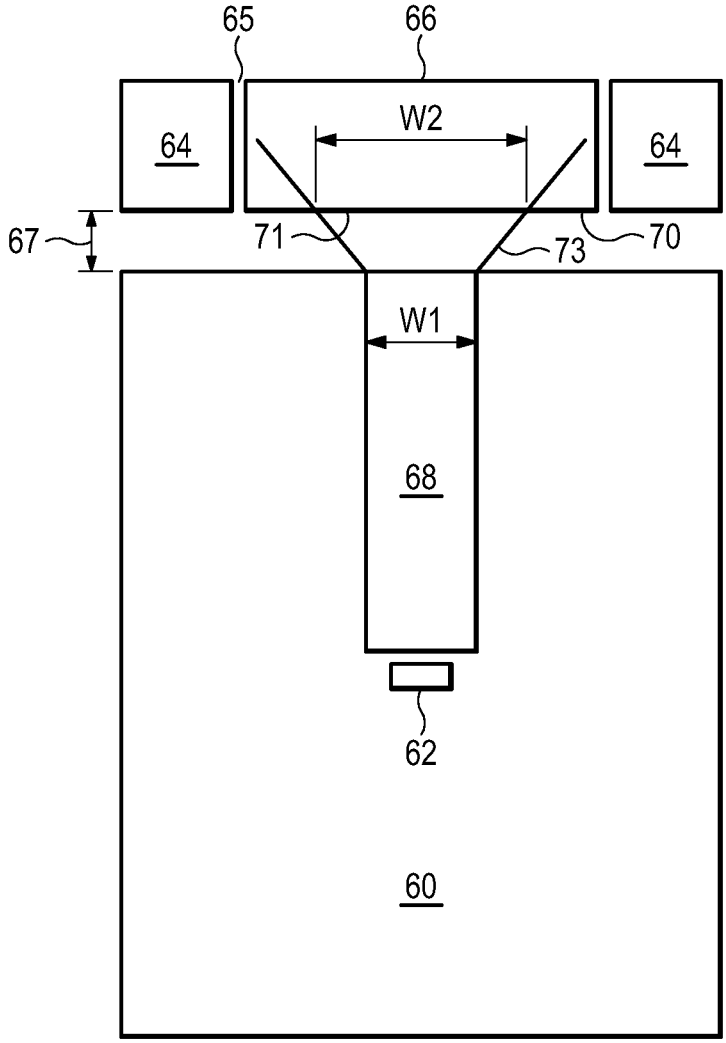
FIG. 8 is a cross-sectional view of an embodiment of a system according to some inventive principles of this patent disclosure.

FIG. 8 illustrates an embodiment of a system according to some inventive principles of this patent disclosure. The embodiment of FIG. 8 includes an electrical device 60 having an indicator light source 62, an actuator 64 having a window 65, a viewing piece 66 arranged to be visible through the window, and a light guide 68 arranged to guide light from the light source to the viewing piece. The back surface 70 of the viewing piece 66 has a receiving portion 71 arranged to receive light 73 from the light guide. The width W2 of the receiving portion is substantially wider than the width W1 of the end of the light guide 68, and thus, the area of the receiving portion is substantially greater than the emitting area of the light that is guided from the indicator source.

The actuator may be arranged to move relative to the electrical device in any suitable manner. For example, the actuator may move up and down relative to the electrical device as shown by arrow 67. In some embodiments, the viewing piece 66 may be attached to, and move with, the actuator 64, while in other embodiments, the viewing piece may be attached to the electrical device 60. In some embodiments, the light pipe 68 may be eliminated, and the indicator light source 62 may be placed closer to the viewing lens.

The viewing piece may be implemented in any suitable manner. For example, in some embodiments, the viewing piece may be a flat piece of transparent material with no or minimal functionality for shaping the pattern of light passing through the piece. In other embodiments, the viewing piece may be implemented as a lens having concave and/or convex surfaces, optical gradients, etc. In some embodiments, the receiving portion 71 may be substantially flat, while in other embodiments, the receiving portion may include a surface shaped to provide lens qualities.

The light guide may be implemented as a light pipe, an optical waveguide, and/or any other suitable structure or combination thereof, to guide light from the indicator light source 62 to the viewing piece.

Figure 9:
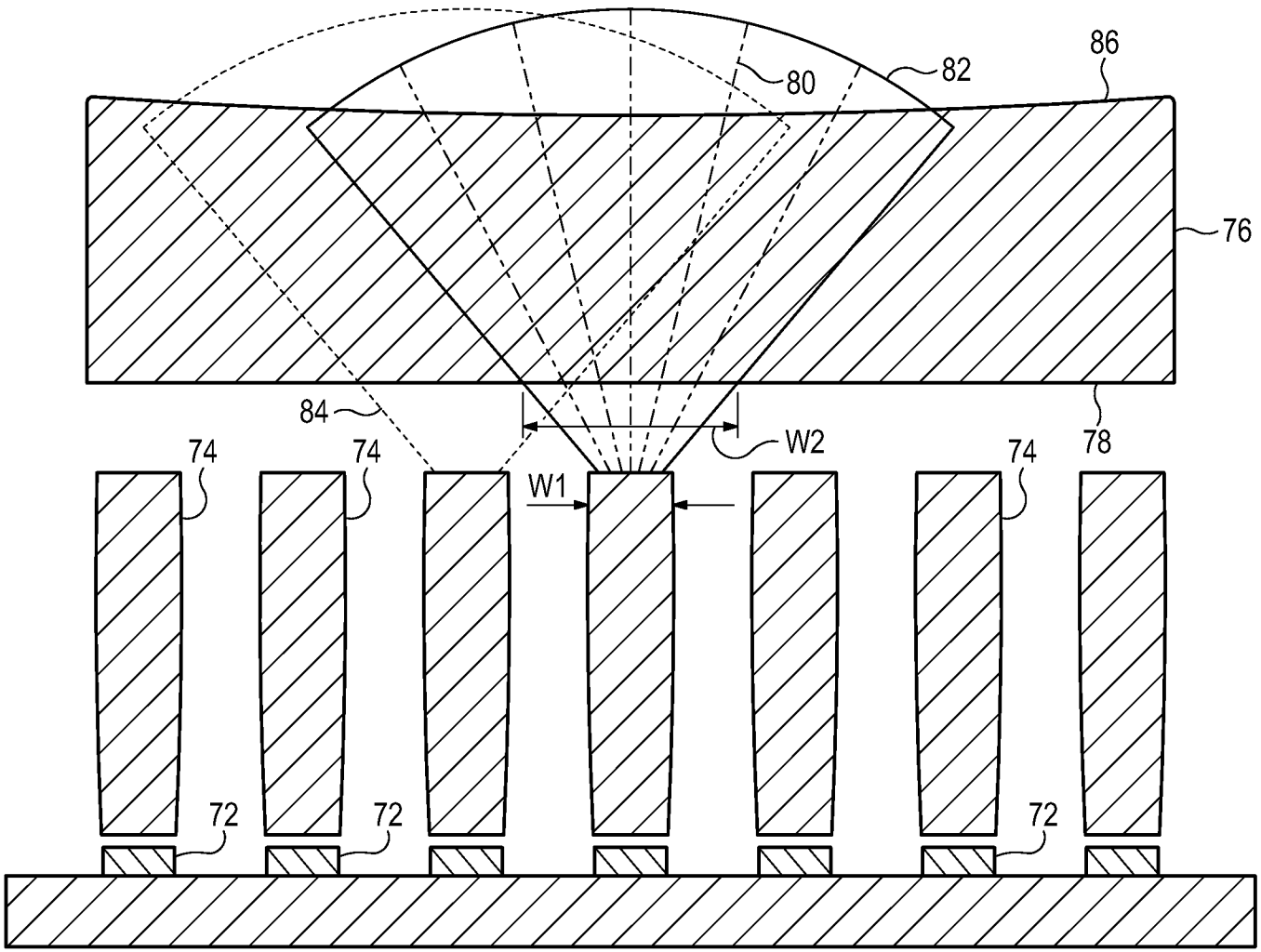
FIG. 9 illustrates an embodiment of a light handling system for an electrical device having an actuator with a viewing window according to some inventive principles of this patent disclosure.

FIG. 9 illustrates an embodiment of a light handling system for an electrical device having an actuator with a viewing window according to some inventive principles of this patent disclosure. The embodiment of FIG. 9 includes a row of indicator light sources 72 and a row of light pipes 74 arranged to guide light from the row of light sources 72 to a viewing lens 76.

The viewing lens has a substantially flat back surface 78 facing the row of light pipes. Compared to the prior art system shown in FIG. 3, the configuration of the viewing lens in the embodiment of FIG. 9 may enable the light 80 emitted from the end of the light pipe to form a wider light pattern 82 in the viewing lens, thereby providing a wider viewing angle. Depending on the implementation details, the viewing angle may be, for example, greater than about 80 degrees.

The back surface 78 of the viewing lens 76 in FIG. 9 includes a light receiving portion corresponding to light pattern 82 having a width W2 that is greater than the width W1 of the corresponding center light pipe. Assuming the light pipes and viewing lens have the same depth, the area of the receiving portion may also be substantially larger than the emitting area of the light pipe.

The relatively wide light pattern 82 of the light from the center light pipe 74 may overlap with the light pattern 84 from the light pipe to the left of the center light pipe. The corresponding light receiving portions on the back surface of the viewing lens may also overlap.

The embodiment of FIG. 9 may also include some additional refinements as follows.

The back surface of the viewing lens may be implemented in a manner that allows the lens to admit light from the light pipes with significant scattering. The back surface may be polished. In this context, polished may refer not only to a surface that is treated by a polishing process, but also a surface that is molded in a form that is smooth enough to produce an adequately smooth surface to have the effect of polishing.

The front surface 86 of the viewing lens 76, i.e., the lens facing a user, may be given a concave shape as shown in FIG. 9. The concave shape may be useful, for example, to match the sculpted contour of an actuator on which in which it is mounted.

The front surface 86 of the viewing lens 76 may be given a texture that improves the viewing qualities. The surface treatment of the prior art viewing lens shown in FIG. 3 may have been selected for properties other than optical transmission. For example, it may be a coarse texture chosen for ease of molding or gripping qualities on other transparent molded parts. In the embodiment of FIG. 9, however, the surface finish may be selected to provide a fine texture for improved light transmission. For example, in the notation of the commonly used Mold-Tech standards, a surface finish of about MT-11055-4 when used on any suitable transparent polymer, may be used. This surface finish, when combined with the other lens geometry discussed above, may slightly diffuse the light as it leaves the lens to provide enhanced visibility and/or viewing angle.

Figure 1:
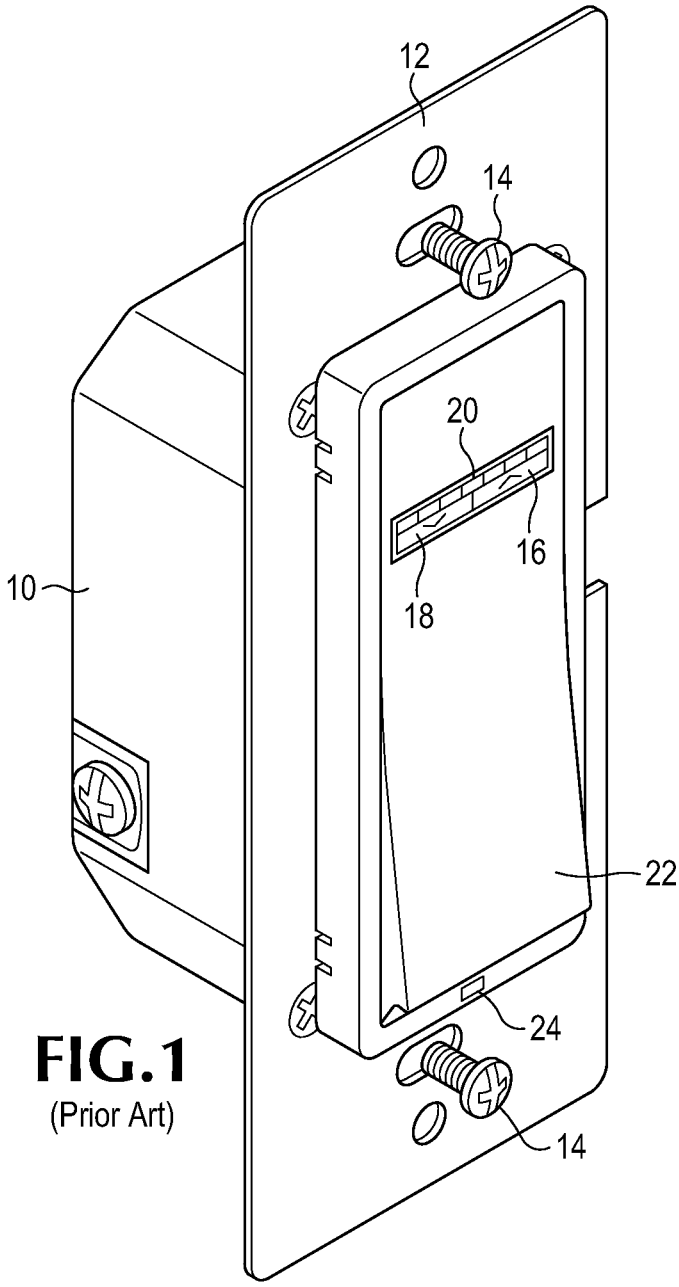
FIG.1 (Prior Art)
FIG. 1 illustrates a prior art dimmer switch.
Figure 2:
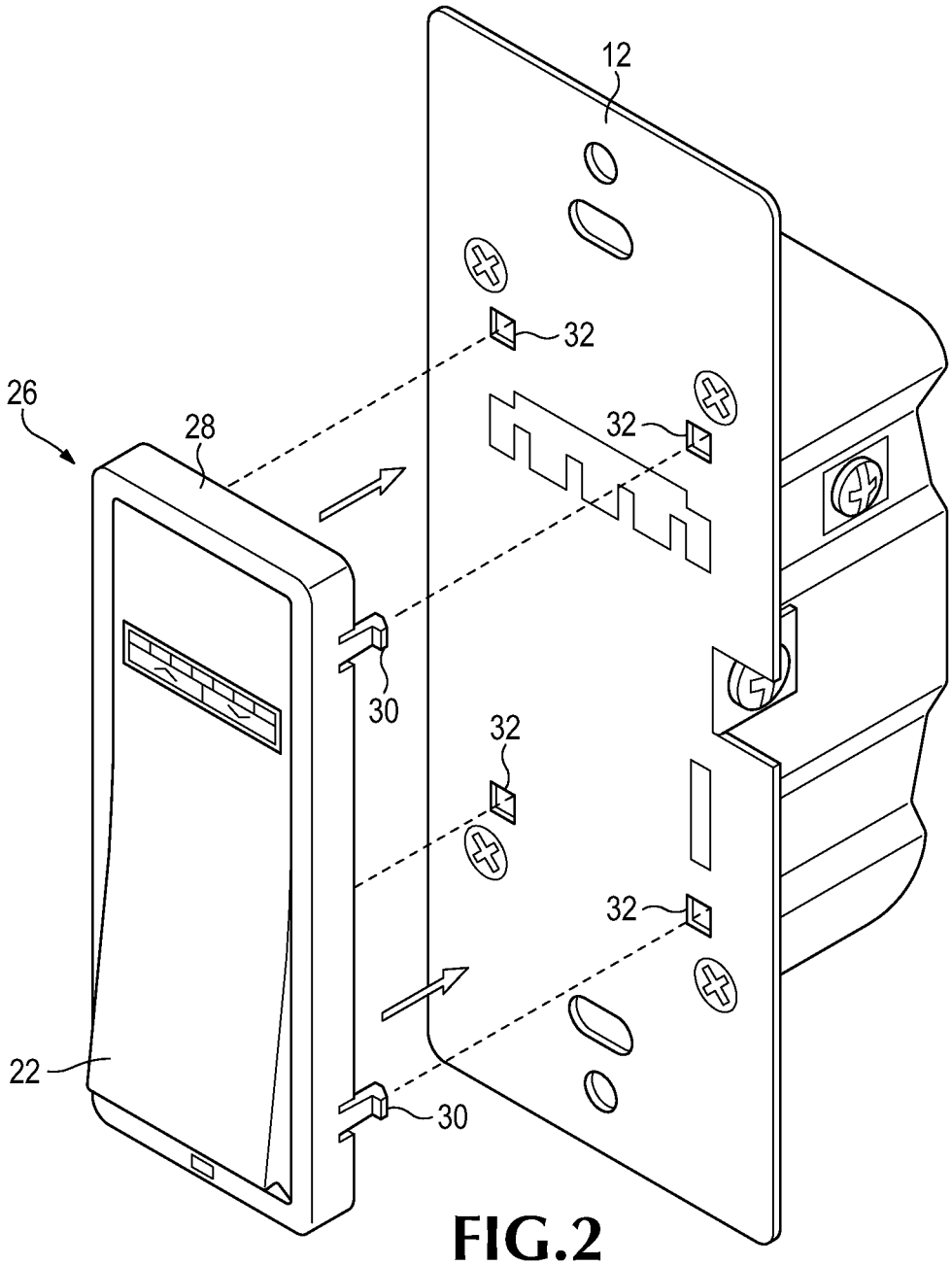
FIG.2 (Prior Art)
FIG. 2 illustrates a prior art color change kit for the dimmer of FIG. 1.
Figure 3:
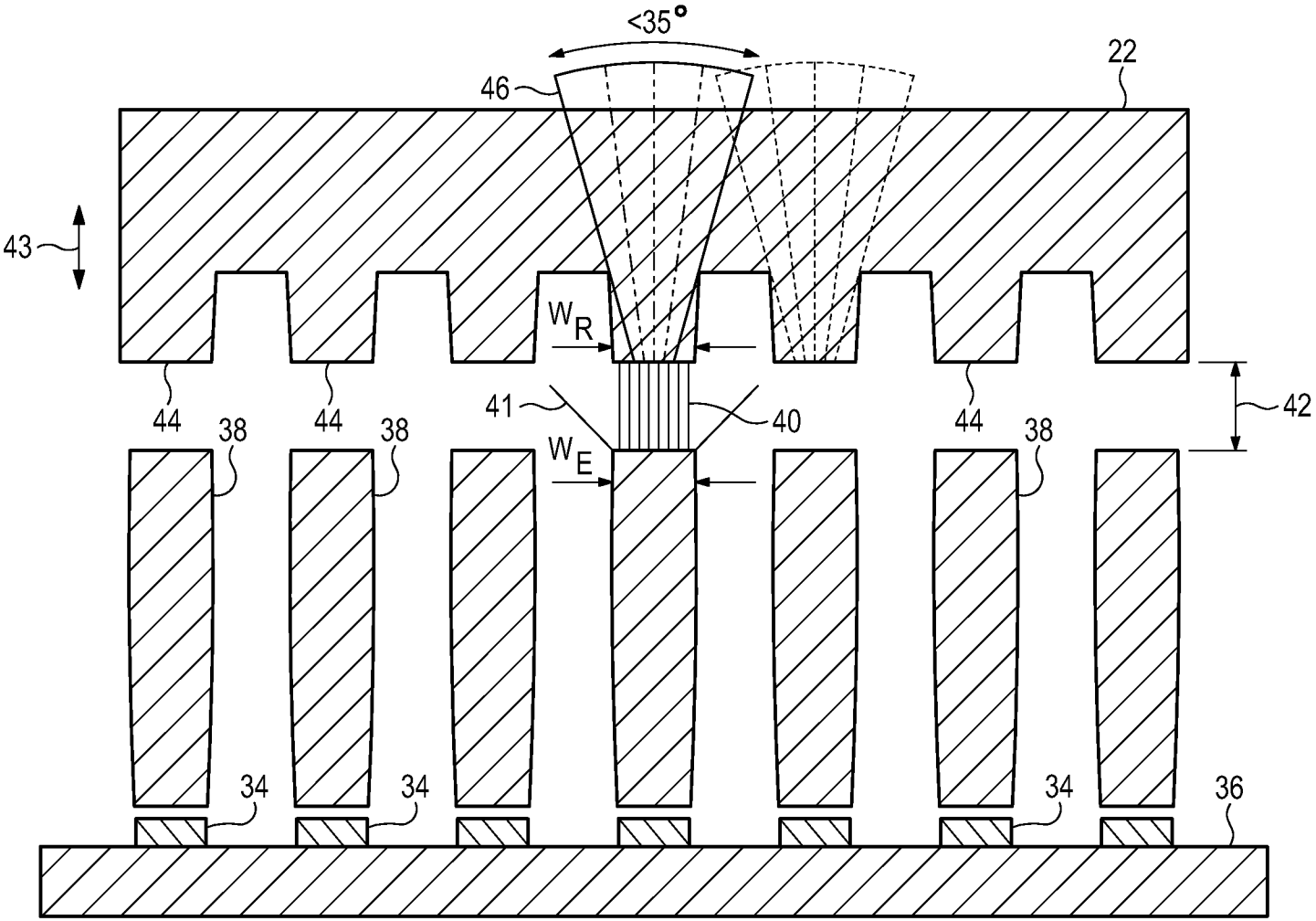
FIG.3 (Prior Art)
FIG. 3 is a cross-sectional view of a prior art light pipe system.
Figure 4:
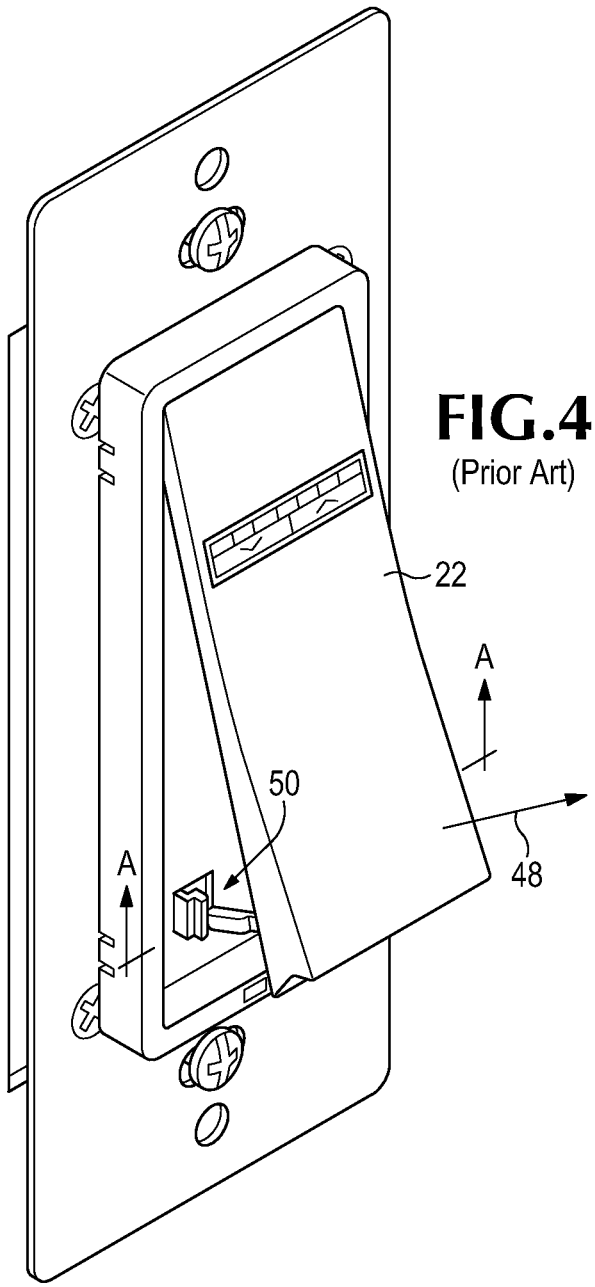
FIG.4 (Prior Art)
FIG. 4 illustrates a prior art flip-up feature of the dimmer of FIG. 1.

Although the embodiment of FIG. 9 is shown with a flat back surface 78, other shapes may be utilized in accordance with the inventive principles of this patent disclosure. For example, the viewing lens 76 may include a pattern having teeth as shown in FIG. 3, but with the width of each tooth being wider than the width of the corresponding light pipe 74 so that the area of each receiving portion is substantially greater than the light emitting area of the corresponding light pipe.

The embodiments of FIGS. 8 and 9 may be adapted to provide additional methods and apparatus for better utilizing the emitted light pattern according to the inventive principles of this patent disclosure. For example, in some alternative embodiments, the viewing piece 66 of FIG. 8 or the viewing lens 76 of FIG. 9 may be arranged to contact the light guide 68 or light pipes 74. In yet other alternative embodiments, the viewing piece or lens may be made integral with the light guide or light pipes.

Figure 10:
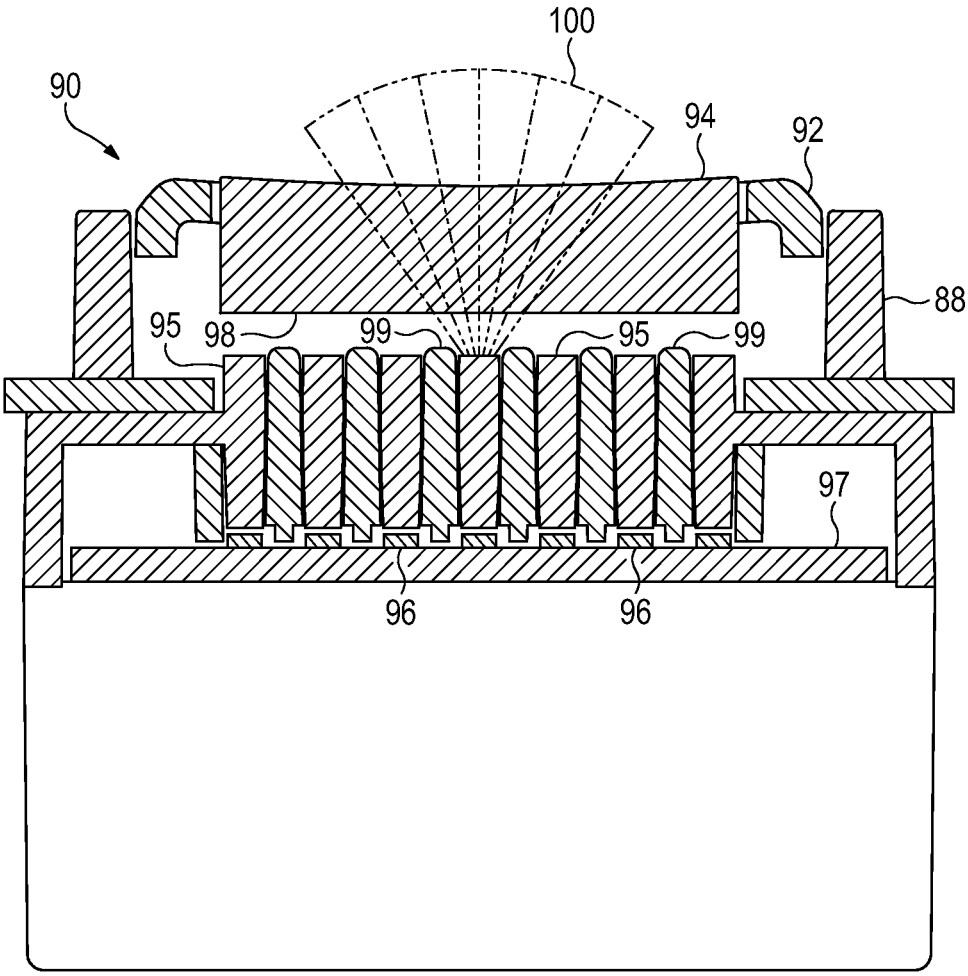
FIG. 10 is a cross sectional view of a dimmer switch having a viewing lens in a movable actuator according to some inventive principles of this patent disclosure.

FIG. 10 is a cross sectional view of a dimmer switch having a viewing lens in a movable actuator according to some inventive principles of this patent disclosure. The embodiment of FIG. 10 includes a frame 88 adapted to be removably attached to an electrical device 90, and an actuator 92 movably mounted in the frame 88. The actuator 92 includes a viewing lens 94 arranged to receive light from a row of light pipes 95 which, in turn, receive light from a row of indicator light sources 96 on a circuit board 97 in the dimmer switch. The viewing lens has a substantially flat back surface 98. The viewing lens is arranged to allow substantial overlap between light patterns 100 from adjacent indicator light sources. Light separators 99 are disposed between the light pipes.

The removable frame 80 and actuator 90 may be implemented, for example, as a color change kit.

Although some of the embodiments described above have been discussed in the context of a dimmer switch having a paddle switch actuator, the inventive principles are applicable to any electrical device having a viewing lens in any type of movable actuator.

Figure 11:
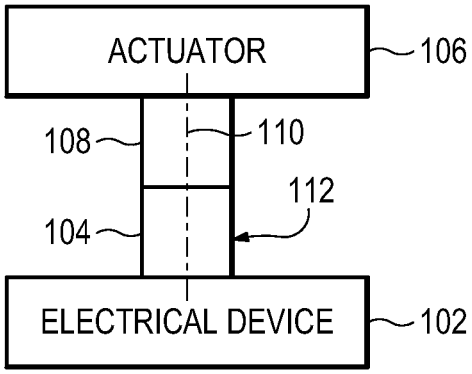
FIG. 11 illustrates an embodiment of a system for supporting an actuator on an electrical device according to some inventive principles of this patent disclosure.

FIG. 11 illustrates an embodiment of a system for supporting an actuator on an electrical device according to some inventive principles of this patent disclosure. The embodiment of FIG. 11 includes an electrical device 102 having a first support member and an actuator 106 having a second support member 108. The actuator is adapted to move along a path of motion 110 from a retracted position to an extended position. The first and second support members are adapted to support the actuator in the extended position with forces that are substantially balanced along the path of motion.

Although shown as components protruding from their respective parts, either of the support members may be an opening, recess or other type of space arranged to engage the other member to support the actuator in an extended position. The electrical device 102 may be any suitable electrical device including switches, fan speed controllers, etc., and the actuator may be any suitable type of actuator such as a paddle, pushpad, rocker, etc. that may need to be supported in an extended position away from the electrical device.

Figure 12:
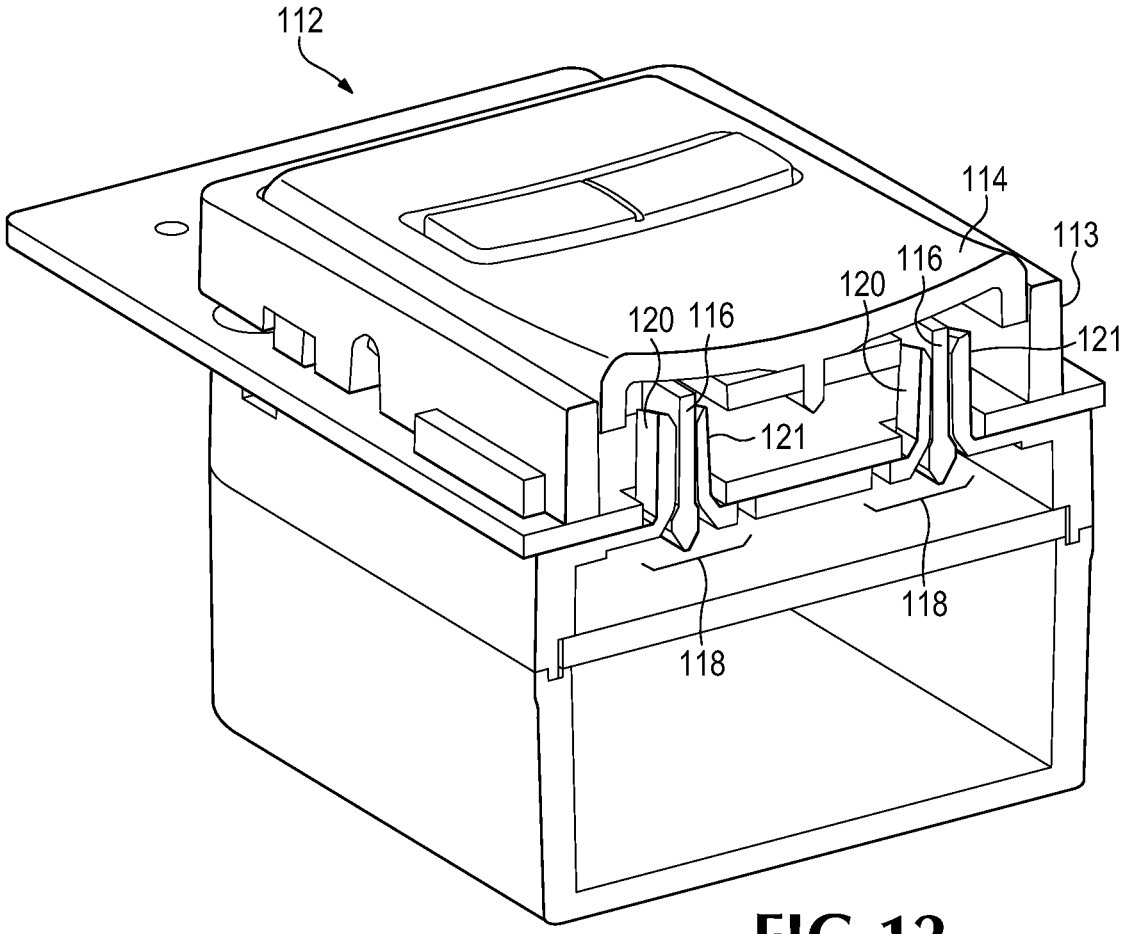
FIGS. 12 and 13 illustrate an example, embodiment of an electrical device having a system for supporting an actuator in an extended position according to some inventive principles of this patent disclosure.
Figure 13:
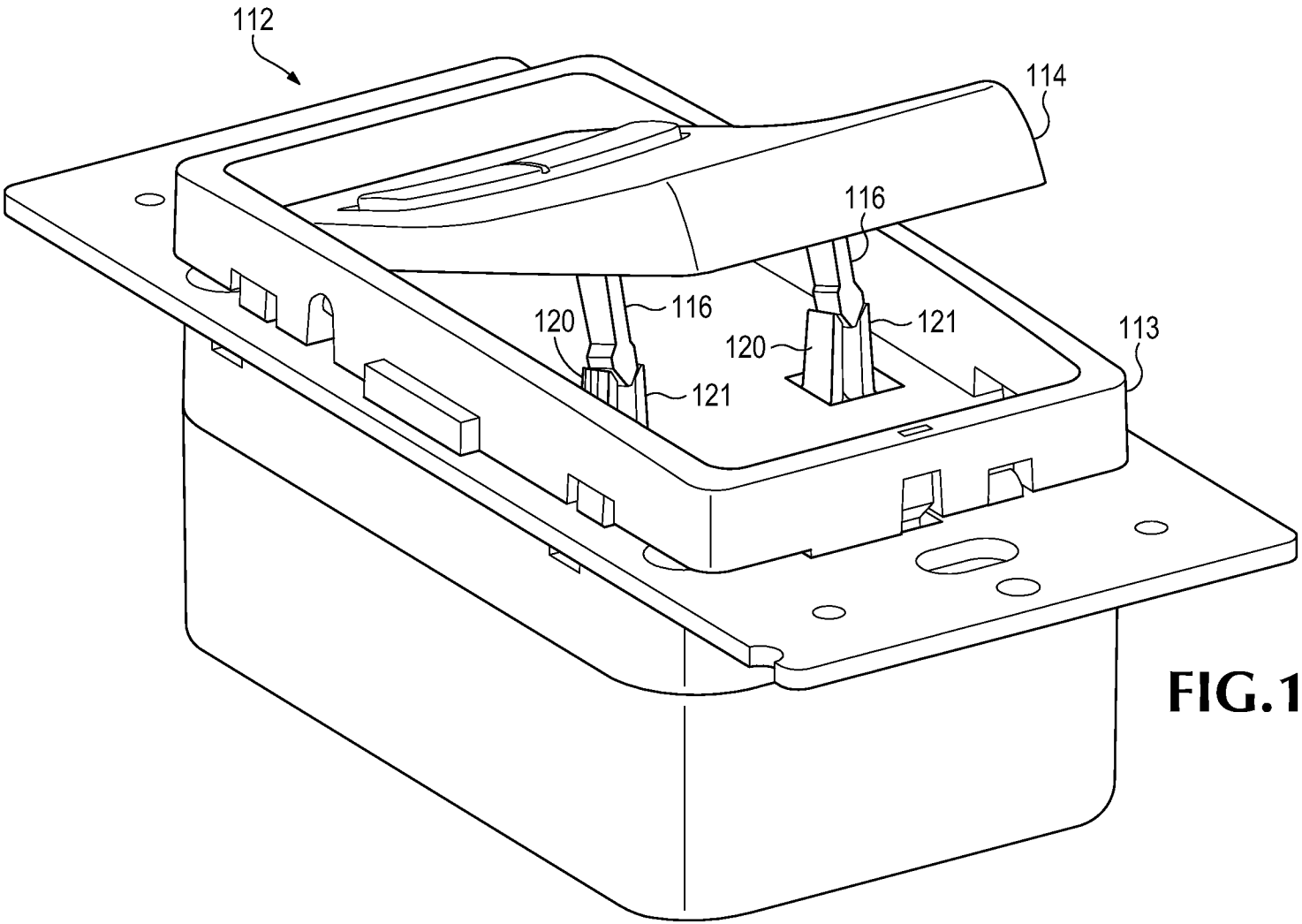

FIGS. 12 and 13 illustrate an example embodiment of an electrical device having a system for supporting an actuator in an extended position according to some inventive principles of this patent disclosure. In the embodiment of FIG. 12, the electrical device 112 is a dimmer switch having a frame 113 adapted to be removably attached to the switch. The actuator 114 is a pushpad that is pivotally mounted in the frame and adapted to rotate from a retracted position as shown in FIG. 12 to an extended position as shown in FIG. 13. The actuator includes two support members 116 adapted to engage two corresponding support members 118 on the switch. The support members on the actuator include opposing surfaces adapted to engage corresponding surfaces on the corresponding support members of the switch to support the actuator in the extended position using symmetric forces.

In the embodiment of FIGS. 12 and 13, each support member 116 on the actuator is implemented as a sliding finger, whereas each support member on the switch 118 is implemented with a pair of support fingers 120 and 121 arranged to engage the sliding finger on opposite sides of the sliding finger.

Figure 14:
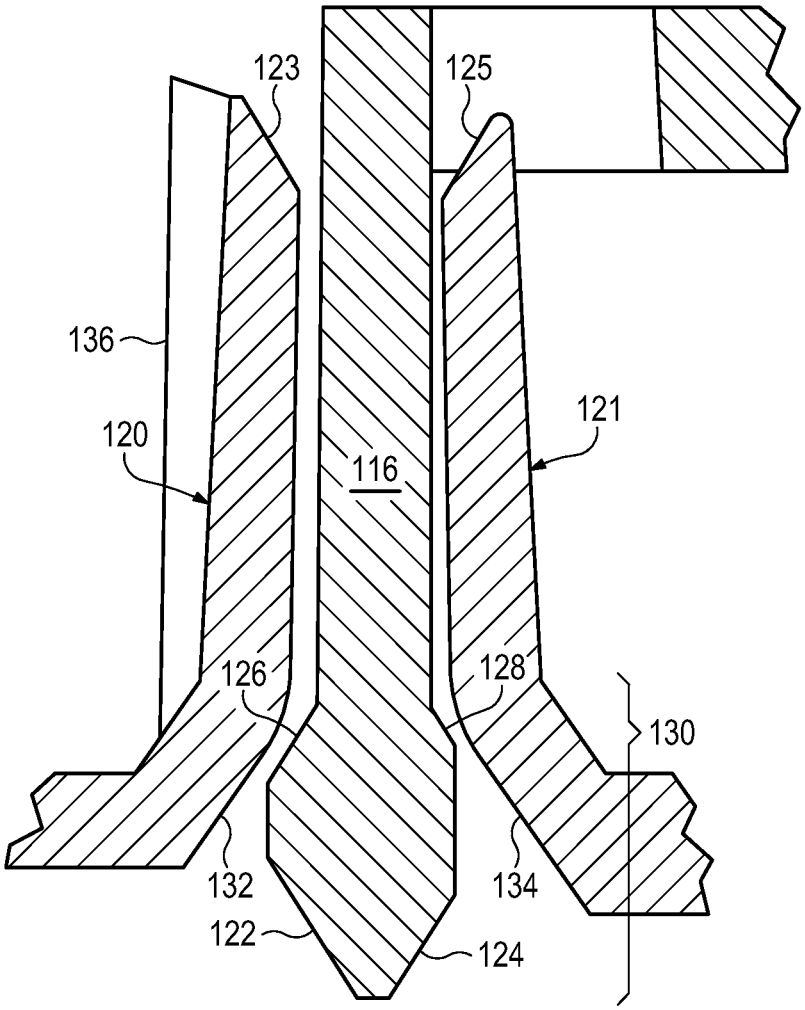
FIG. 14 is a cross-sectional view showing more details of the embodiment of FIGS. 12 and 13.

FIG. 14 is a cross-sectional view showing more details of one of the sliding fingers 116 and a pair of the support fingers 120,121. The sliding finger 116 includes an enlarged end portion 130 having two opposing sloped surfaces 122 and 124. Each of the support fingers 120 and 121 includes a sloped surface 123 and 125 arranged to engage one of the sloped surfaces of the sliding finger when the actuator is in the extended position. The sliding finger 116 includes two additional sloped surfaces 126 and 128, and each of the support fingers 120 and 121 includes an additional sloped surface 132 and 134 arranged to engage one of the additional sloped surfaces of the sliding finger to hold the actuator in the retracted position, which is illustrated in FIG. 14. Thus, the enlarged end portion 130 may have a generally diamond-shaped appearance.

As the pushpad actuator is moved between the retracted and extended positions, the enlarged portion of the sliding finger forces the support fingers apart to enable the enlarged portion to slide between the support fingers. Thus, the forces on the sliding finger may be substantially symmetric about a center line through the sliding finger which follows the path of motion of the sliding finger. These forces may be substantially symmetric while the sliding finger is moving between the support fingers, as well as when the actuator is in the retracted and extended positions.

Figure 15:
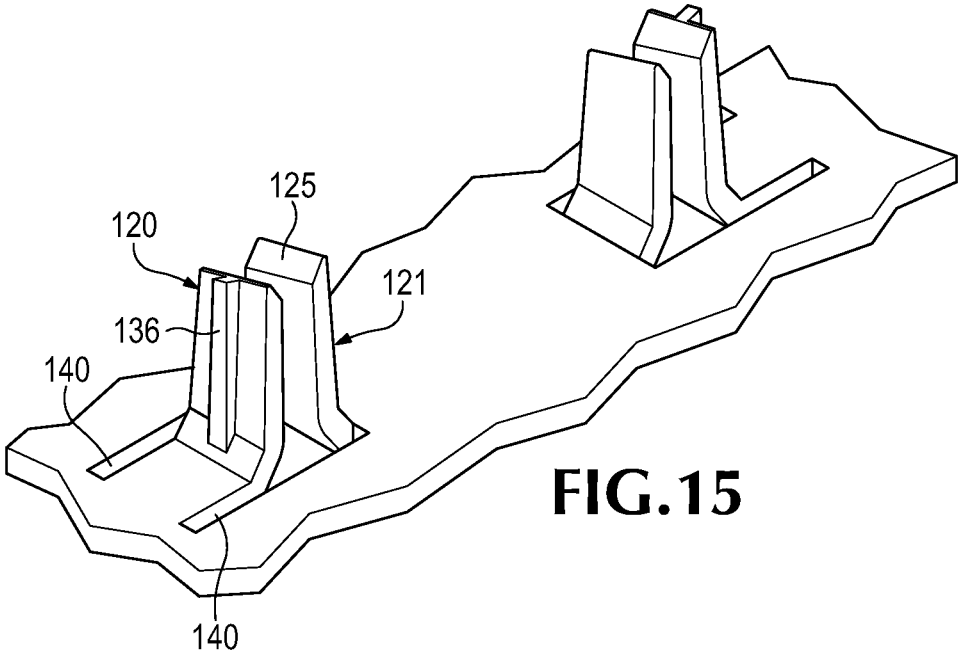
FIGS. 15 and 16 are perspective views illustrating some additional details of the embodiment of FIG. 14.
Figure 16:
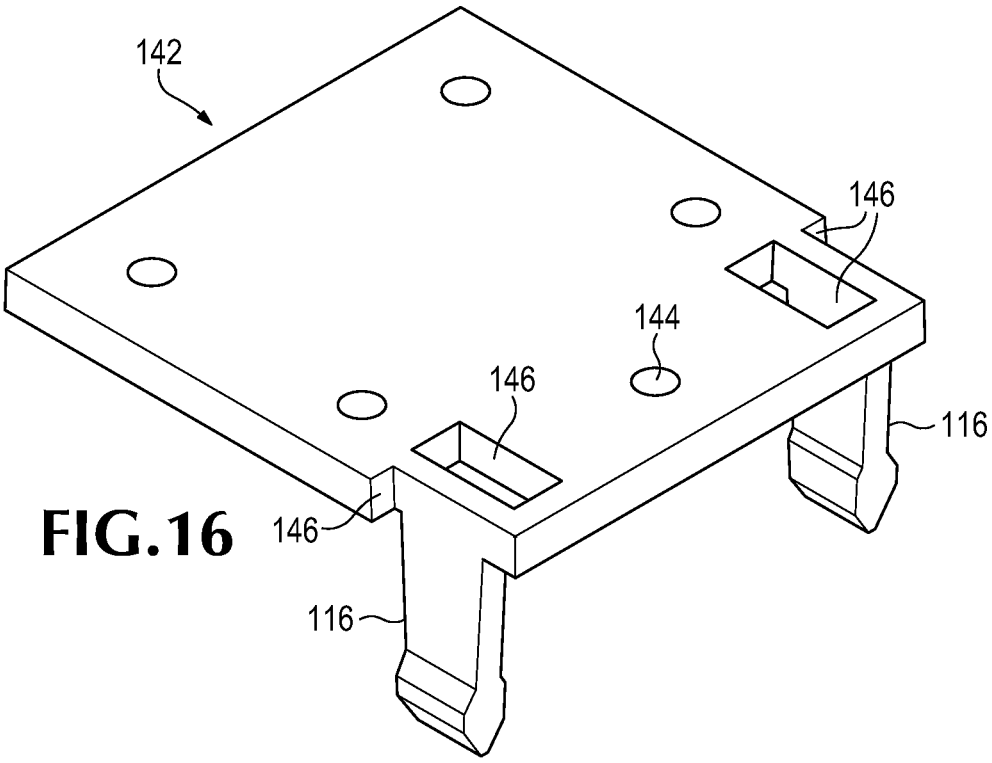

FIGS. 15 and 16 are perspective views illustrating some additional details of the sliding fingers 116 and support fingers 120 and 121. Referring to FIG. 15, support finger 120 includes a stiffening rib 136 and is attached to a portion of the subframe having slots 140 to provide the finger 120 with an additional dimension of motion relative to the subframe. The sloped surfaces 125 (which is visible on support finger 121) and 122 (which is not visible in this view) are also sloped slightly rearward toward the pivot point of the pushpad actuator to accommodate the pivoting motion imparted to the sliding finger 116.

Referring to FIG. 16, the sliding fingers 116 are formed on a mounting plate 142 which may be attached to the actuator through any suitable means such as heat staking through holes 144. The mounting plate 142 includes openings 146 to accommodate the ends of the support fingers 120,121 when the actuator is in the retracted position.

Figure 5:
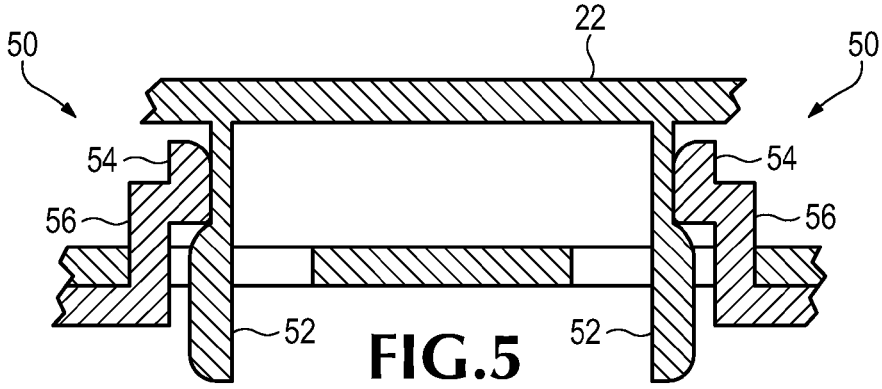
FIG.5 (Prior Art)
FIGS. 5-7 are cross-sectional views of the support mechanism for the dimmer of FIG. 1.
Figure 6:
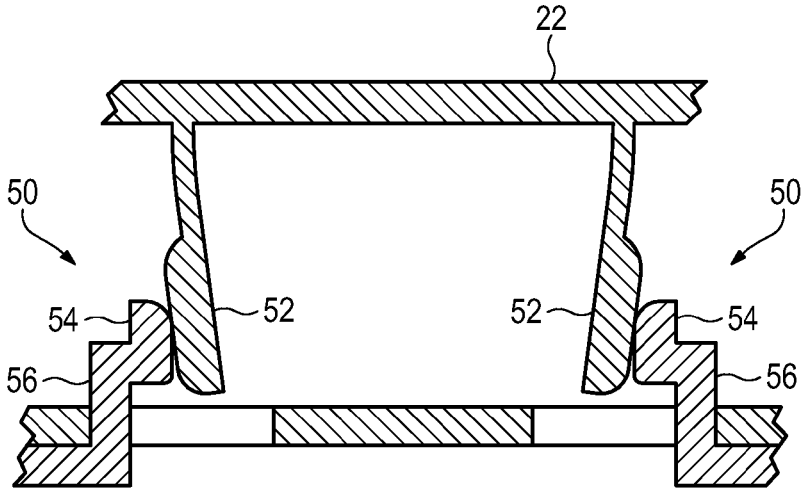
FIG.6 (Prior Art)
Figure 7:
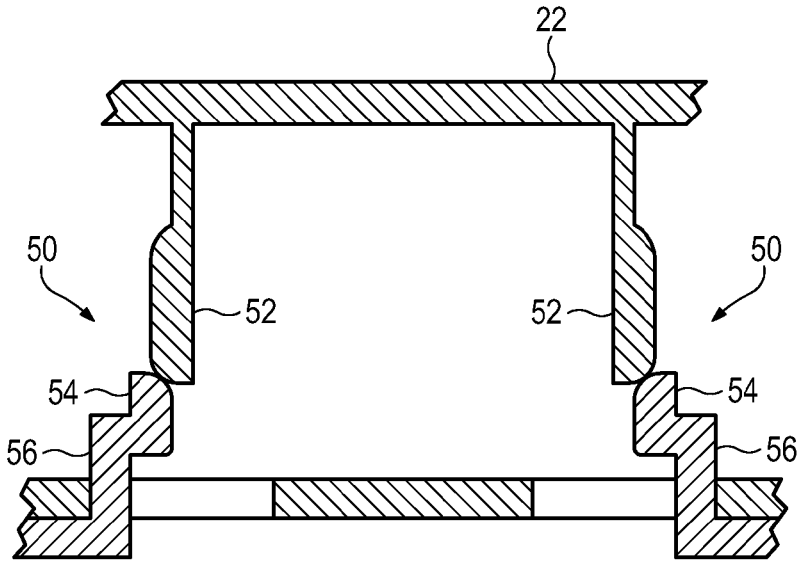
FIG.7 (Prior Art)

The inventive principles of this patent disclosure may enable the use of only a single support member on the actuator and a single support member on the electrical device. For example, referring again to FIG. 13, if one of the sliding fingers 116 and the corresponding pair of support fingers 120,121 are eliminated, the actuator may still operate properly. This may be better understood by comparison to the prior art system of FIG. 5 which relies on the presence of both latches 52. The forces on each individual latch 52 are asymmetric, i.e., one sided. If one of the latches and/or supports 56 is removed or broken, unbalanced forces would be applied to the actuator which, in turn, may prevent the actuator from moving properly and/or being held in either position. It may also cause the actuator to pop out of its pivoting frame.

In contrast, one of the sliding fingers 116 and the corresponding pair of support fingers 120,121 may be eliminated from the embodiment of FIG. 13, and the forces on the remaining sliding finger, and thus, the actuator, may remain balanced. Eliminating one of the sliding fingers and the corresponding pair of support fingers may be help in situations where space is limited and/or where additional features are added to the electrical device.

Although some of the embodiments described above have been discussed in context of a dimmer switch having a pivoting pushpad actuator, the inventive principles are applicable to any type of electrical device having any type of actuator that may need to be supported in an extended position.

A challenge in the design of electrical devices involves adapting existing functional criteria to new aesthetic designs. For example, newly emerging design criteria for wiring devices may call for user interfaces having larger wall plate surfaces and actuators than existing products. The structure under the wall plate, however, must continue to fit inside standard electrical boxes.

Figure 17:
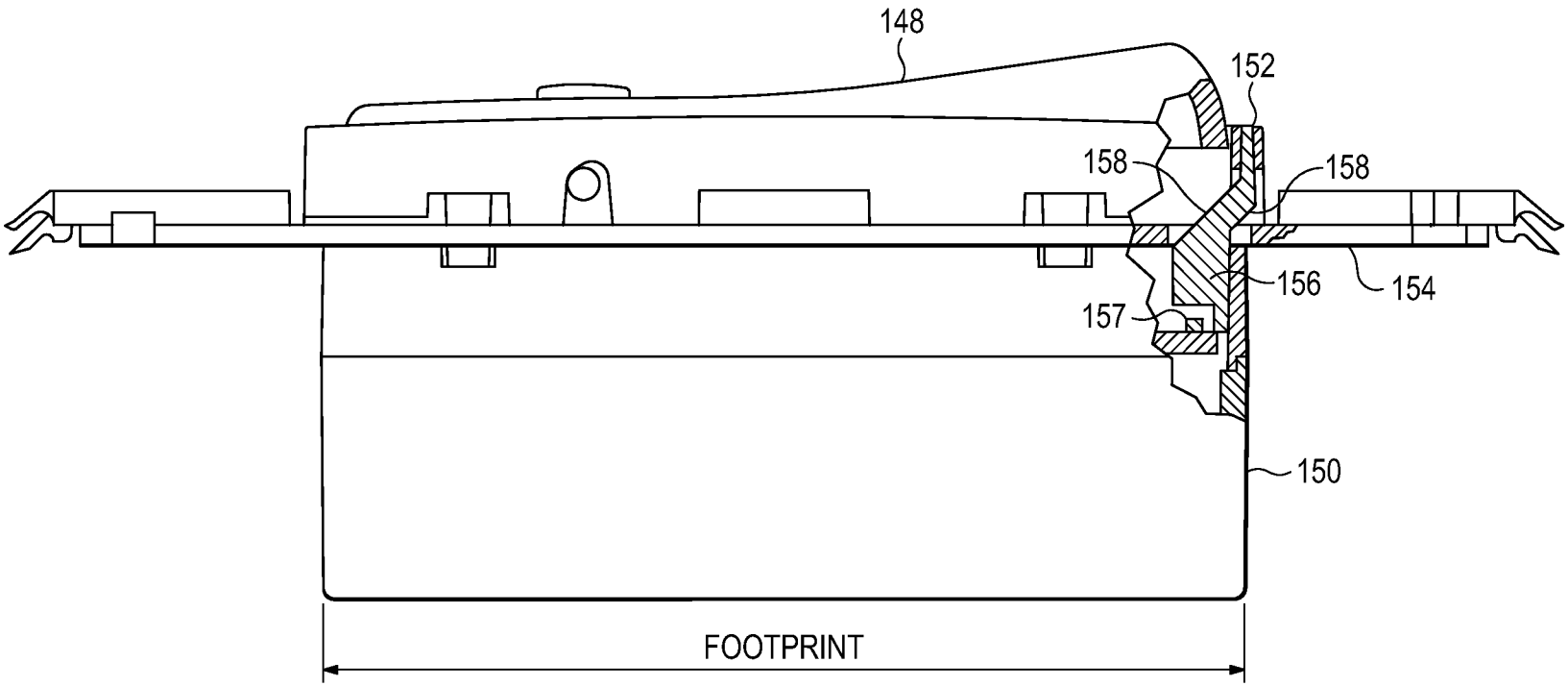
FIG. 17 illustrates an example embodiment of a light pipe system according to some inventive principles of this patent disclosure.

FIG. 17 illustrates an example embodiment of a light pipe system according to some inventive principles of this patent disclosure. The embodiment of FIG. 17 is illustrated as a dimming switch having an actuator 148 that is very nearly as long as the housing 150 of the wiring device which must fit inside a standard electrical box. Thus, an illumination aperture 152 for a locator light may fall at least partially outside of the footprint of the housing on the plane of the mounting plate 154. The embodiment of FIG. 17 includes a light pipe 156 having reflective surfaces 158 configured to guide light from a light source 157 inside the housing to the aperture 152.

Figure 18:
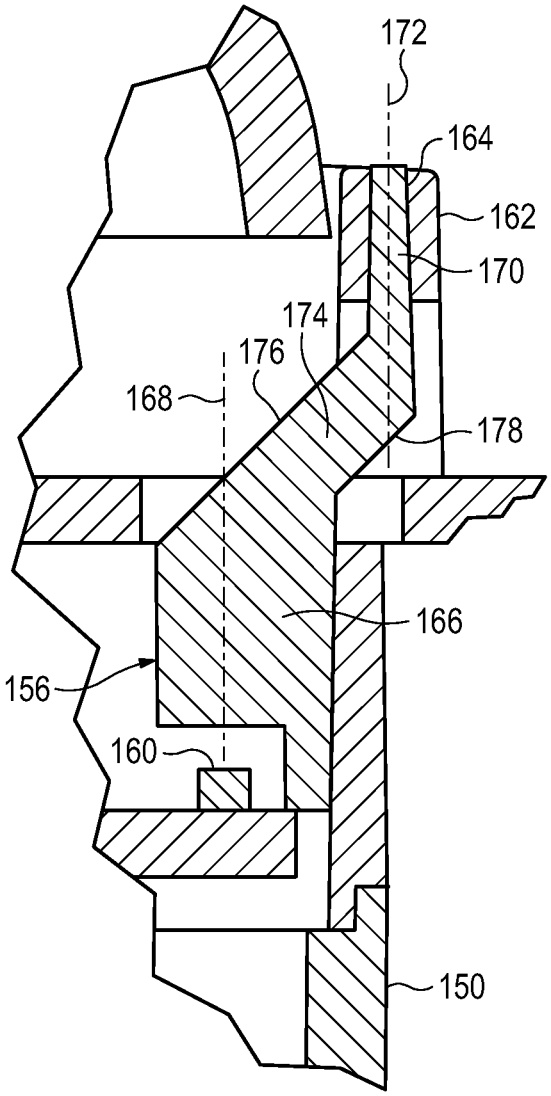
FIG. 18 is an enlarged cross-sectional view of the light pipe arrangement of FIG. 17.

FIG. 18 is an enlarged cross-sectional view of the light pipe arrangement of FIG. 17. The embodiment of FIG. 18 includes a housing 150 arranged to enclose one or more electrical components, an indicator light source 160 located within the housing, a face portion 162 having an aperture 164 for transmitting light from the indictor light source through the face portion, and a light pipe 156 arranged to guide light from the indicator light source through the aperture. The housing has a footprint on a mounting plane, and the aperture is located outside of the footprint of the housing.

The light pipe 156 includes a first portion 166 having an axis 168 aligned with the indicator light source 160 and a second portion 170 having an axis 172 that is offset from the first axis and aligned with the aperture 164. A third portion 174 of the light pipe connects the first and second portions. The light pipe also includes a first reflecting surface 176 arranged to direct light from the first portion to the third portion, and a second reflecting surface 178 arranged to direct light from the third portion to the second portion.

Some additional inventive principles of this patent disclosure relate to a method including generating light with a row of indicator light sources on an electrical device, guiding light from the row of indicator light sources through a viewing lens on a movable actuator attached to the electrical device, and allowing light patterns from adjacent indicator light sources to overlap substantially within the viewing lens. In some embodiments, the method may further include guiding light from the row of indicator light sources to the viewing lens with a row of light pipes. In some embodiments, the method may further include receiving light from each light pipe over an area on a back surface of the viewing lens that is greater than the cross-sectional area of a corresponding light pipe. In some embodiments, the method may further include diffusing light at a front surface of the viewing lens.

Some additional inventive principles of this patent disclosure relate to a method including holding an actuator on an electrical device in a first position, moving the actuator from the first position to a second position, and supporting the actuator in the second position with a support member, where the support member only experiences substantially balanced forces as the actuator moves from the first position to the second position. In some embodiments, the support member may include a finger having an enlarged end portion. Moving the actuator from the first position to the second position may include pushing the sliding finger between a pair of support fingers. In some embodiments, the support member may be attached to the actuator. In some embodiments, the support member may be attached to the electrical device. In some embodiments, the first position may be a retracted position close to the electrical device, and the second position may be an extended position away from the electrical device.

The inventive principles of this patent disclosure have been described with reference to some specific example embodiments, but these embodiments can be modified in arrangement and detail without departing from the inventive concepts. Thus, any changes and modifications are considered to fall within the scope of the following claims.

The invention claimed is:

1. A system comprising:
an electrical device having an indicator light source;
an actuator having a window;
a viewing piece arranged to be visible through the window; and
a light guide separate from the viewing piece arranged to guide light from the light source to the viewing piece;
where the viewing piece has a receiving portion arranged to receive light from the light guide; and
where the width of the receiving portion is substantially larger than the width of the light guide.

2. The system of claim 1 where the viewing piece is attached to the actuator.

3. The system of claim 1 where the viewing piece is attached to the electrical device.

4. The system of claim 1 where:
the electrical device includes a plurality of indicator light sources and a plurality of light guides arranged to guide light from the light sources to the viewing piece;
the viewing piece has a plurality of receiving portions arranged to receive light from the light guides; and
the widths of the receiving portions are substantially larger than the widths of the corresponding light guides.

5. The system of claim 1 where the receiving portion of the viewing piece comprises a polished surface.

6. The system of claim 1 where:
the viewing piece has a front surface; and
at least a portion of the front surface is one selected from the group consisting of textured and concave.

7. An interchange kit comprising:
a frame adapted to be removably attached to an electrical device having an indicator light source;
an actuator movably mounted to the frame; and
a viewing piece attached to the actuator;
where the viewing piece has a receiving portion arranged to receive light from the indicator light source through an emitting area of a light guide on the electrical device, wherein the viewing piece is separate from the emitting area; and
where the area of the receiving portion is substantially larger than the emitting area.

8. The interchange kit of claim 7 where
the viewing piece has a front surface; and
at least a portion of the front surface is one selected from the group consisting of textured and concave.

9. The interchange kit of claim 7 where:
the electrical device includes a plurality of indicator light sources;
the viewing piece has a plurality of receiving portions arranged to receive light from the indicator light sources through a plurality of emitting areas on the electrical device; and
the viewing piece is arranged to allow substantial overlap between light patterns from adjacent emitting areas.

10. The interchange kit of claim 7 where the receiving portion of the viewing piece has a substantially flat surface.

11. A system comprising:
an electrical device having a first support member extending from a surface of the electrical device; and
a paddle actuator having a second support member;
where the paddle actuator is adapted to pivot along a path of motion from a retracted position to an extended position; and
where the first and second support members are adapted to support the paddle actuator in the extended position with forces that are substantially balanced along the path of motion.

12. The system of claim 11 where:
one of the support members comprises a sliding finger; and
the other support member comprises a pair of support fingers arranged to engage the sliding finger on opposite sides of the sliding finger.

13. The system of claim 12 where:

the sliding finger comprises two opposing sloped surfaces; and each of the support fingers comprise a sloped surface arranged to engage one of the sloped surfaces of the sliding finger when the paddle actuator is in the extended position.

14. The system of claim 13 where:

the sliding finger comprises two additional sloped surfaces; and each of the support fingers comprise an additional sloped surface arranged to engage one of the additional sloped surfaces of the sliding finger to hold the paddle actuator in the retracted position.

15. The system of claim 11 where the first and second support members are adapted to hold the paddle actuator in the retracted position.

16. The system of claim 11 where the paddle actuator is arranged to actuate a switch when the actuator is in the extended position.

17. The system of claim 16 where the switch comprises an air gap switch.

18. An interchange kit comprising:

a frame adapted to be removably attached to an electrical device; and a paddle actuator pivotally mounted in the frame and adapted to rotate from a retracted position to an extended position;

where the paddle actuator includes a support member adapted to engage a corresponding support member on the electrical device; and where the support member on the paddle actuator includes opposing surfaces adapted to engage corresponding surfaces on the corresponding support member of the electrical device to support the actuator in the extended position using symmetric forces.

19. The interchange kit of claim 18 where the paddle actuator is adapted to be removably mounted in the frame.

20. The interchange kit of claim 18 where one of the support members comprises a sliding finger having an enlarged end portion.

21. The interchange kit of claim 20 where the enlarged end portion has a diamond-shaped cross section.

22. An electrical device comprising:

a housing arranged to enclose one or more electrical components;

an indicator light source;

a face portion having an aperture to enable light from the indicator light source to pass through the face portion; and a light guide arranged to guide light from the indicator light source to the aperture;

where the housing has a footprint on a mounting plane; and where at least a portion of the aperture is located outside of the footprint of the housing.

23. The electrical device of claim 22 where the light guide includes:

a first portion having an axis aligned with the indicator light source; and a second portion having an axis offset from the first axis and aligned with the aperture.

24. The electrical device of claim 23 where the light guide further includes a third portion arranged to guide light from the first portion to the second portion.

25. The electrical device of claim 24 where the light guide further includes:

a first reflecting surface arranged to direct light from the first portion to the third portion; and a second reflecting surface arranged to direct light from the third portion to the second portion.

26. The system of claim 1 wherein the viewing piece and the light guide are separated by a gap and causes the light to form a light pattern wider than the light guide.

27. The system of claim 4, wherein the multiple light guides having separators between them.

28. The electrical device of claim 22, wherein the light guide has at least one portion offset from at least one other portion of the light guide.

* * * * *